US010578391B2

(12) United States Patent
Scott et al.

(10) Patent No.: US 10,578,391 B2
(45) Date of Patent: Mar. 3, 2020

(54) PROTECTIVE COVER FOR A FIREARM

(71) Applicant: ScopeCoat, LLC, Virginia Beach, VA (US)

(72) Inventors: Michael D. Scott, San Tan Valley, AZ (US); Eric M. Yeates, Virginia Beach, VA (US)

(73) Assignee: Scopecoat, LLC, Virginia Beach, VA (US)

( * ) Notice: Subject to any disclaimer, the term of this patent is extended or adjusted under 35 U.S.C. 154(b) by 0 days.

(21) Appl. No.: 15/735,651

(22) PCT Filed: Jun. 13, 2016

(86) PCT No.: PCT/US2016/037239
§ 371 (c)(1),
(2) Date: Dec. 12, 2017

(87) PCT Pub. No.: WO2016/201437
PCT Pub. Date: Dec. 15, 2016

(65) Prior Publication Data

US 2018/0356177 A1 Dec. 13, 2018

Related U.S. Application Data

(60) Provisional application No. 62/174,635, filed on Jun. 12, 2015.

(51) Int. Cl.
*F41A 35/04* (2006.01)
*F41A 35/02* (2006.01)
*F41C 33/06* (2006.01)

(52) U.S. Cl.
CPC ..... *F41A 35/04* (2013.01); *F41A 35/02* (2013.01); *F41C 33/06* (2013.01)

(58) Field of Classification Search
CPC ..... F41A 35/04; F41A 35/02; F41A 35/06
USPC ..... 42/96, 70.07, 74; 224/243; 203/317
See application file for complete search history.

(56) References Cited

U.S. PATENT DOCUMENTS 2,914,377 A 11/1959 Bull
2,932,334 A * 4/1960 Steen ..... F41A 35/02 206/317
4,395,837 A 8/1983 Durnal
(Continued)

OTHER PUBLICATIONS

Beretta Tactical Pistol Rug (10 inch), https://www.berettausa.com/en-us/beretta-tactical-pistol-rug-10-inch-/fo6401890999, (Year: 2012).*

*Primary Examiner* — Samir Abdosh
(74) *Attorney, Agent, or Firm* — Shaddock Law Group, PC

(57) ABSTRACT

A protective cover for a firearm having a front muzzle portion; a rear slide portion substantially parallel to and spaced apart from the front muzzle portion; an elongate body portion extending between and secured to the front muzzle portion and the rear slide portion; a trigger guard cover portion that extends from the body portion to cover at least a portion of a trigger guard of said firearm to be disposed within the protective cover; and a longitudinally extending cover opening in the body portion through which at least a portion of said firearm extends to be disposed within the protective cover, wherein said cover opening extends between said trigger guard cover portion and said rear slide portion.

18 Claims, 8 Drawing Sheets

(56) References Cited

U.S. PATENT DOCUMENTS

| | | | | | |
|---|---|---|---|---|---|
| 4,645,103 | A * | 2/1987 | Bianchi | F41C 33/0227 | 224/192 |
| 4,858,361 | A | 8/1989 | White | | |
| 5,094,376 | A * | 3/1992 | Baruch | F41A 17/54 | 224/193 |
| 5,632,426 | A * | 5/1997 | Beletsky | A45F 5/021 | 224/192 |
| 5,661,920 | A | 9/1997 | Evans | | |
| 5,678,344 | A * | 10/1997 | Jones | F41C 33/06 | 42/96 |
| 5,829,179 | A * | 11/1998 | Carter | E05B 37/16 | 42/70.07 |
| 5,850,706 | A | 12/1998 | Evans | | |
| 6,119,388 | A * | 9/2000 | Jones | F41A 35/02 | 42/96 |
| 8,056,713 | B2 | 11/2011 | Evans | | |
| 8,757,821 | B2 * | 6/2014 | Quinnan | F41G 1/383 | 359/511 |
| D777,287 | S * | 1/2017 | Scott | D22/108 | |
| D777,288 | S * | 1/2017 | Scott | D22/108 | |
| 9,603,426 | B2 | 3/2017 | Evans | | |
| 2005/0279789 | A1 * | 12/2005 | Lowe | F41C 33/0209 | 224/244 |
| 2012/0061432 | A1 * | 3/2012 | Novak | F41C 33/0209 | 224/243 |
| 2018/0356177 | A1 * | 12/2018 | Scott | F41A 35/02 | |

* cited by examiner

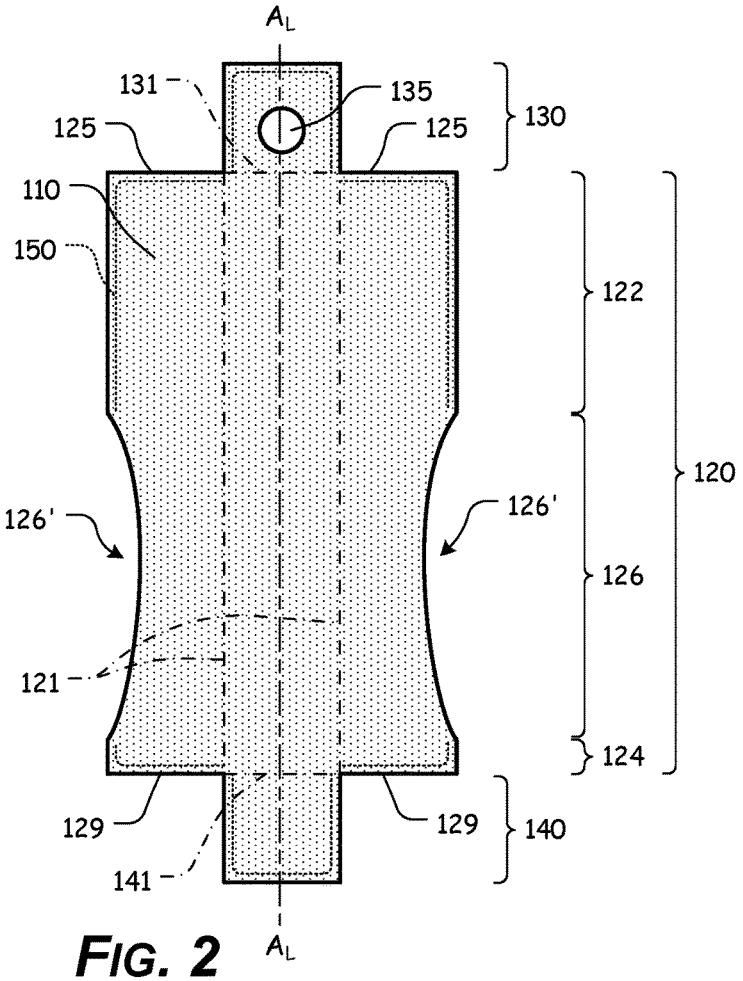
FIG. 2
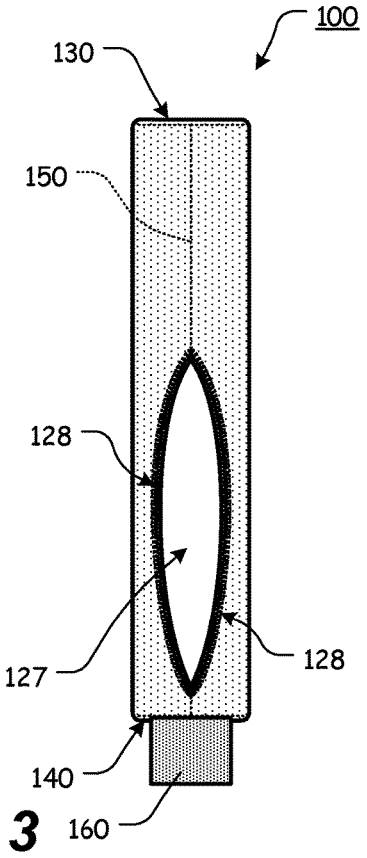
FIG. 3
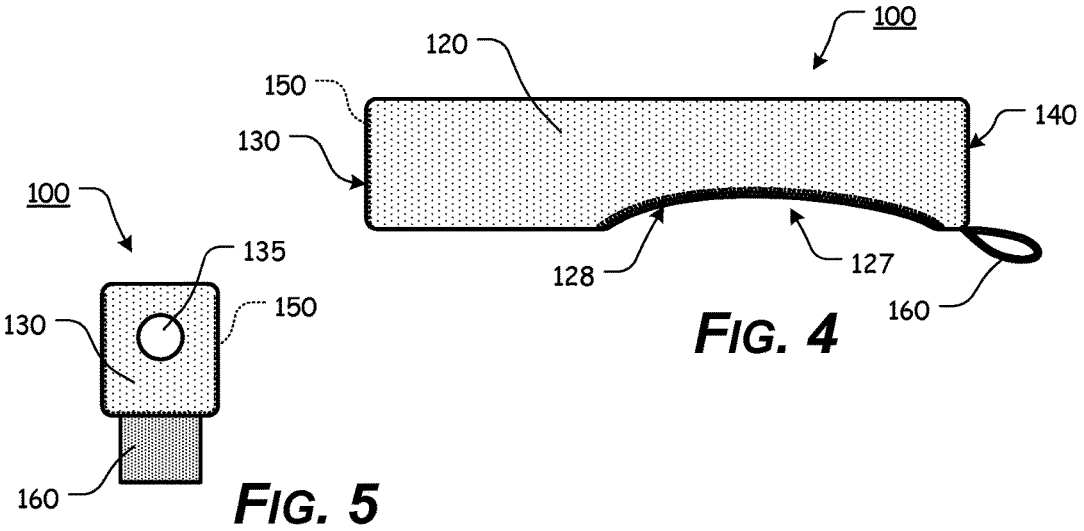
FIG. 4
FIG. 5

PROTECTIVE COVER FOR A FIREARM

CROSS-REFERENCE TO RELATED APPLICATIONS

This patent application claims the benefit of U.S. Patent Application Ser. No. 62/174,635, filed Jun. 12, 2015, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present disclosure

The present disclosure relates generally to the field of firearms. More specifically, the present disclosure relates to a protective cover for a firearm for a firearm.

2. Description of Related Art

When stored with other items, such as, for example, handguns, rifles, firearms, accessories, or equipment, or when being transported from place to place with other items, portions of a firearm, such as, for example, a handgun slide or rifle barrel or upper receiver can be nicked, scratched, marred, or otherwise damaged, thus lowering its value and degrading its appearance. If the damage is significant enough, the coding covering certain portions of the firearm can be removed, allowing certain portions of the firearm to be more susceptible to corrosion. The same is true if the firearm has an attached optic, light, laser, or other accessory or device.

Hard plastic handgun cases and zippered pouches called "gun rugs", are bulky, ill-fitting, and do not facilitate convenience when transporting or storing several handguns. When equipped with locking mechanisms, immediate access to the firearm is denied. These hard cases require a considerable amount of space to store.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

Unfortunately, when stored with other firearms, or when being transported from place to place with other firearms and/or equipment, certain areas or portions of the firearm or attached accessories or devices can be nicked, scratched, marred, or otherwise damaged. Known gun cases and/or gun rugs are bulky, require considerable space to store, and prevent immediate access to the handgun in an emergency. Known gun rugs can and do absorb any moisture in the surrounding atmosphere and can harm a firearm's finish.

The disadvantages and shortcomings of the prior art are overcome by the features and elements of the protective cover for a firearm of the present disclosure. The protective cover of the present disclosure can be employed when a user stores, displays, or transports the firearm, with or without other attached accessories or devices. The cover will prevent nicks, scratches, and marring that would damage or degrade portions of the firearm.

The advantages of the present disclosure are attained, in certain exemplary, nonlimiting embodiments, by providing a protective cover for a firearm, comprising a cover body comprising a substantially flexible fabric or other material. The body comprises a body portion, extending from a first edge to a second edge, and having a forward frame portion, a rear frame portion, and a cover opening concavity disposed between the forward frame portion and the rear frame portion. A front muzzle portion extends from the first edge and a rear slide portion extends from the second edge.

Each cover opening concavity comprises a concavity that extends inwardly from the forward frame portion and/or the rear frame portion.

Once the blank of the body is created, the body portion is folded along body portion fold lines, the front muzzle portion is folded along front muzzle portion fold line, and the rear slide portion is folded along rear slide portion fold line. The folded portions are then stitched along at least certain of the stitch lines to form the protective cover.

The cover opening concavity portion are not stitched together, but define a cover opening, which is formed so as to allow at least a portion of a firearm to pass through the cover opening and be fitted at least partially within the protective cover.

In certain exemplary, nonlimiting embodiments, the protective cover provides a formed and fitted shape, which covers at least a portion of the firearm, thus keeping the surface of covered portion of the firearm from contacting anything that could nick, scratch, mar, or otherwise damage the covered portion of the firearm.

In certain exemplary embodiments, a barrel aperture (an opening cut, or slit) is formed through a portion of the front muzzle portion. The barrel aperture, if included, allows the firearm to be stored on a rack designed to hang the firearm from a rod or dowel inserted into its barrel, while still being covered.

In various exemplary embodiments, certain areas that may see excessive wear or stress (for example, proximate the front and rear sights) are reinforced. A loop of nylon or other material may be included to act as a pull tab proximate the rear of the cover, allowing the cover to be easily pulled into place.

In various exemplary, nonlimiting embodiments, the cover is securely stitched on all the edges, and adjoining seams are stitched to provide secure and reliable, long-lasting service through repeated applications and removals to and from the firearm.

In certain exemplary, nonlimiting embodiments, the protective cover further comprises at least one trigger blocking element, which is positioned such that when a firearm is appropriately inserted within the protective cover, the at least one trigger blocking element prevents portions of the body from being deformed and allowing contact with the trigger of the inserted firearm.

Accordingly, the presently disclosed systems, methods, and/or apparatuses provide a protective cover fora firearm.

The presently disclosed systems, methods, and/or apparatuses separately and optionally provide a protective cover for a firearm that allows for the convenient and space-saving storage of a handgun, rifle, or firearm, while giving protection to the various portions of the firearm.

The presently disclosed systems, methods, and/or apparatuses separately and optionally provide a protective cover for a firearm that provides a relatively formfitting protective cover.

The presently disclosed systems, methods, and/or apparatuses separately and optionally provide a protective cover for a firearm that can allow for immediate access to the firearm.

The presently disclosed systems, methods, and/or apparatuses separately and optionally provide a protective cover fora firearm that at least partially encloses the firearm within the protective cover.

The presently disclosed systems, methods, and/or apparatuses separately and optionally provide a protective cover for a firearm that at least partially covers the trigger guard of the firearm within the protective cover.

The presently disclosed systems, methods, and/or apparatuses separately and optionally provide a protective cover for a firearm that may optionally be formed of a fabric or other material that does not readily absorb moisture.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein:

FIG. 2 illustrates a top view of an exemplary embodiment of a blank for a protective cover, according to the presently disclosed systems, methods, and/or apparatuses;

FIG. 3 illustrates a bottom view of an exemplary embodiment of a protective cover, according to the presently disclosed systems, methods, and/or apparatuses;

FIG. 4 illustrates a side view of an exemplary embodiment of a protective cover, according to the presently disclosed systems, methods, and/or apparatuses;

FIG. 5 illustrates a front view of an exemplary embodiment of a protective cover, according to the presently disclosed systems, methods, and/or apparatuses;

DETAILED DESCRIPTION OF THE PRESENT DISCLOSURE

Figure 1:
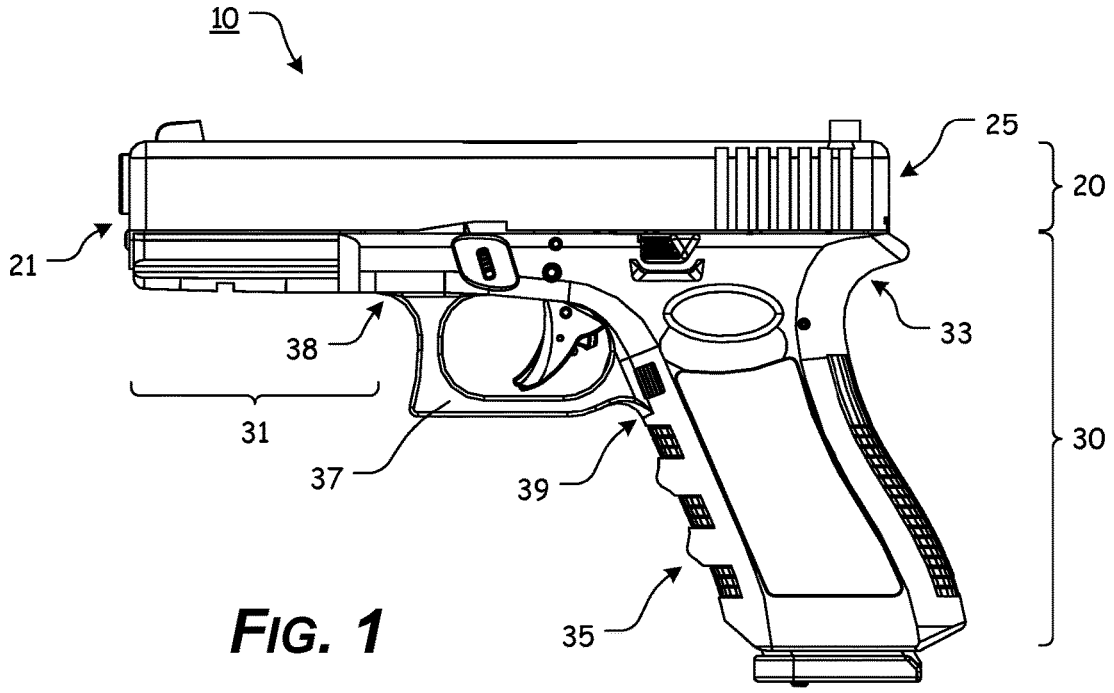
FIG. 1 PRIOR ART
FIG. 1 illustrates a side view of an exemplary, known handgun.
Figure 6:
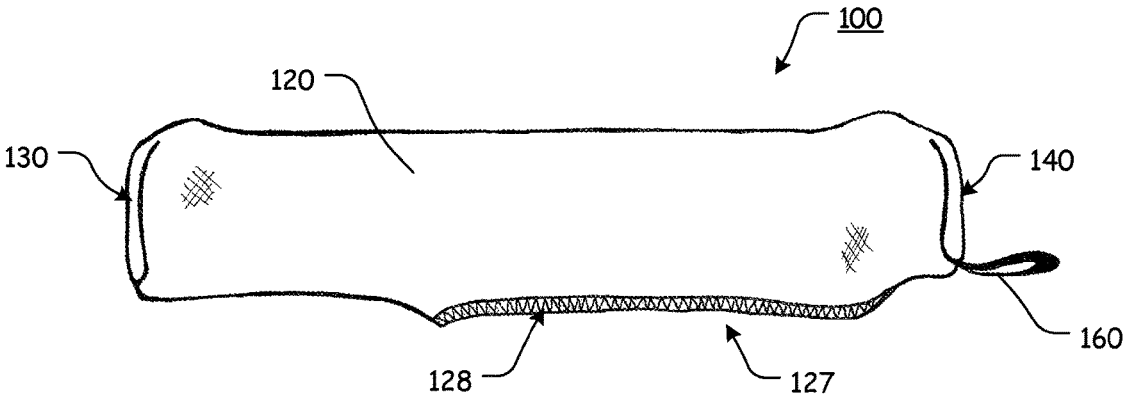
FIG. 6 illustrates a side view of an exemplary embodiment of a protective cover, according to the presently disclosed systems, methods, and/or apparatuses.

For simplicity and clarification, the design factors and operating principles of the protective cover according to the presently disclosed systems, methods, and/or apparatuses are explained with reference to various exemplary embodiments of a protective cover according to the presently disclosed systems, methods, and/or apparatuses. The basic explanation of the design factors and operating principles of the protective cover is applicable for the understanding, design, and operation of the protective cover of the presently disclosed systems, methods, and/or apparatuses. It should be appreciated that the protective cover can be adapted to many applications where a protective cover or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "protective cover", "handgun", "rifle", and "firearm" are used for basic explanation and understanding of the operation of the presently disclosed systems, methods, and/or apparatuses. Therefore, the terms "protective cover", "handgun", "rifle", and "firearm" are not to be construed as limiting the systems, methods, and/or apparatuses of the present disclosure. Thus, for example, the term "handgun" is to be understood to broadly include any handgun or other handheld tool or device, while the term "rifle" is to be understood to broadly include any upper, lower, or combined receiver for a firearm or other similar handheld or shoulder mounted device or tool.

For simplicity and clarification, the protective cover of the present disclosure will be described as being used in conjunction with various firearms, such as a pistol or handgun and an AR-15 or M4 style rifle or carbine. However, it should be appreciated that these are merely exemplary embodiments of the protective cover and are not to be construed as limiting the presently disclosed systems, methods, and/or apparatuses. Thus, the protective cover of the present disclosure may be utilized in conjunction with any firearm, such as, for example, a pistol, handgun, rifle, air rifle, paintball marker, Airsoft pistol or rifle, replica pistol or rifle, or any other tool, device, or object.

Turning now to the drawing FIGS., as discussed above, FIG. 1 illustrates a side view of an exemplary, known handgun 10, while FIGS. 2-19 illustrate certain elements and/or aspects of an exemplary embodiment of a protective cover 100, a protective cover 200, a protective cover 300, a protective cover 400, and a protective cover 500, according to the presently disclosed systems, methods, and/or apparatuses.

As illustrated in FIG. 1, a typical, known semi-automatic handgun 10 includes a slide 20 and a frame 30. The slide 20 extends from a muzzle end 21 to a rear end 25 of the slide 20. The frame 30 includes a forward frame dust cover 31, a grip 35, and a trigger guard 37. The forward frame dust cover 31 and the trigger guard 37 intersect at a dust cover/trigger guard interface 38, while the grip 35 and the trigger guard 37 intersect at a trigger guard/grip interface 39. The rear of the grip 35 ends in a rounded or curved beaver tail 33.

It should be appreciated that the handgun 10 can be a typical, semi-automatic handgun. It should also be appreciated that while shown as being a semi-automatic handgun, the handgun 10 may be an actual or replica semi-automatic handgun, revolver, Taser, or any other known or later developed handheld weapon or tool. A more detailed explanation of the elements and components of the handgun 10 is not provided herein because such components or elements will be known to one of ordinary skill in the art. Therefore, it is believed that the level of description provided herein is sufficient to enable one of ordinary skill in the art to understand and practice the present disclosure, as described.

In illustrative, non-limiting embodiments of the present disclosure, as illustrated in FIGS. 2-10, the protective cover 100 comprises at least some of a cover body 110 comprising a body portion 120 extending from a first edge 125 to a second edge 129 and having a forward frame portion 122, a rear frame portion 124, and a cover opening concavity portion 126 disposed between the forward frame portion 122 and the rear frame portion 124. A front muzzle portion 130 extends from the first edge 125 and a rear slide portion 140 extends from the second edge 129.

In various exemplary embodiments, the cover body 110 comprises a substantially elastic or flexible fabric or other material. The material chosen to form the cover body 110 provides a degree of padding and protection to the covered portions of the handguard 10. In addition, the material is at least somewhat stretchable, elastic, and flexible. This allows the protective cover 100 to stretch, as needed, to fit over the desired portions of the handgun 10. Once fitted, the protective cover 100 will remain in place by the inherent elasticity of the material out of which the protective cover 100 is made.

In various exemplary, nonlimiting embodiments, the cover body 110 is formed of neoprene, foamed neoprene, polychloroprene, Lycra, spandex, or another synthetic rubber or closed cell foam. In certain exemplary embodiments, the cover body 110 comprises a nylon outer portion or "skin", a nylon inner portion or "skin", and a neoprene or other closed cell foam material positioned between the outer portion and the inner portion. The material or materials used to form the outer portion and the inner portion may be chosen so as to provide a relatively slick or friction free surface, so as not to introduce frictional engagement problems when the protective cover 100 is removed from the handgun 10 or to wear or abrade, unnecessarily, the surface of the handgun 10.

In certain exemplary embodiments, the material used to form the cover body 110 is at least partially water repellent, water resistant, or waterproof. Alternatively, the material used to form the cover body 110 is designed to remove or wick water or moisture from the handgun 10 so that moisture will be drawn away from the portions of the handgun 10 that are covered by the protective cover 100. An additional liner may be included that is impregnated with a rust inhibitor, oil, desiccant, or the like. Alternatively, portions of the cover body 110 may be impregnated with a rust inhibitor, oil, desiccant, or the like.

It should be appreciated that the fabric or material used to form the cover body 110, as well as the thickness of the fabric or material, is a design choice based upon the desired degree of elasticity, flexibility, resilience, protection, and/or wear resistance of the protective cover 100.

Additionally, certain areas of the outer portion or inner portion of the cover body 110 may be reinforced with, for example, additional portions of the fabric or other materials to strengthen those portions of the protective cover 100 or provide additional wear resistance and prevent premature wear on certain areas. For example, areas covering or contacting the front and rear sights of the handgun 10 may be reinforced with nylon.

The cover body 110 comprises a body portion 120, extending from a first edge 125 to a second edge 129. The body portion 120 comprises a forward frame portion 122 and a rear frame portion 124. A cover opening concavity portion 126 is disposed between the forward frame portion 122 and the rear frame portion 124. The cover opening concavity portion 126 comprises opposing concavities 126' that extend inwardly from the forward frame portion 122 and/or the rear frame portion 124.

The depth and shape of each of the concavities 126' of the cover opening concavity portion 126 is determined based upon the desired overall size and shape of the resulting cover opening 127. Thus, the cover opening concavity portion 126 form the opposing sides of the cover opening 127 by which the handgun 10 is inserted into the protective cover 100. Or, phrasing it in the opposite manner, portions of the handgun 10 extend into the protective cover 100, through the cover opening 127 defined by the concavities 126' of the cover opening concavity portion 126.

A front muzzle portion 130 extends from the first edge 125 and a rear slide portion 140 extends from the second edge 129.

As illustrated, the cover body 110 is shown as being generally symmetrical about the longitudinal axis, $A_L$. However, it should be understood that the cover body 110 may be substantially symmetrical about the longitudinal axis or may be partially or fully asymmetrical, depending upon the shape of the handgun 10 or the desired portions of the handgun 10 that are to be covered.

The overall size and shape of each portion of the cover body 110 is dictated by the size and shape of the handgun with which the protective cover 100 is to be used. For example, the overall length, width, and shape of the body portion 120 are dictated largely by the overall length, height, and width of the slide 20 and the portion of the slide and/or frame 30 that is to be covered by the protective cover 100. The overall length, width, and shape of the forward frame portion 122 are dictated largely by the overall length, height, and width of the forward frame dust cover 31, between the muzzle end 21 and the dust cover/trigger guard interface 38. The overall length, width, and shape of the rear frame portion 124 are dictated largely by the overall length, height, and width of the length, width, and shape of the beavertail 33 and the configuration between the beavertail 33 and the rear end 25 of the slide 20.

The overall length, depth, and shape of the cover opening concavity portion 126 is dictated by the distance between the dust cover/trigger guard interface 38 and the beavertail 33. Additionally, the length, depth, and shape of the cover opening concavity portion 126 will be determined, based upon the desired amount of the frame 30 and/or slide 20 that is desired to be covered or left exposed.

Similarly, the overall length, width, and shape of the front muzzle portion 130 and the rear slide portion 140 are dictated by the overall length, width, and shape of the muzzle end 21 and the rear of the slide end 25, respectively.

Furthermore, the overall length, width, and shape of the cover body 110 and the various elements thereof may be dictated based upon the degree of stretch or flexibility of the material used to form the cover body 110 and the degree of form fitting (snugness and tightness of the fit) desired for the protective cover 100.

In various exemplary, nonlimiting embodiments, variations in the pattern of the cover body 110 may be included to accommodate all or at least portions of certain attached accessories or devices (such as, for example, lights and or lasers) removably attached or coupled to the handgun 10.

In certain exemplary, nonlimiting embodiments, a barrel aperture 135 is formed through a portion of the front muzzle portion 130. In these exemplary embodiments, the barrel aperture 135 is formed such that, once the handgun 10 is positioned within the protective cover 100, the handgun 10 may be stored on a rack designed to hang the handgun 10 from a rod or dowel inserted into the barrel of the handgun 10, while the slide 20 is still covered by the protective cover 100.

A pattern or steel die may optionally be used to cut a flat piece of material to a predetermined shape to form the blank of the cover body 110.

Once the blank of the cover body 110 is created, the body portion 120 is folded along body portion fold lines 121, the front muzzle portion 130 is folded along front muzzle portion fold line 131, and the rear slide portion 140 is folded along rear slide portion fold line 141. The folded portions are then appropriately secured together, along at least certain of the mating or adjacent stitch lines 150 to form the protective cover 100. For example, adjacent portions of the first edge 125 and the front muzzle portion 130 are appropriately secured together and opposing portions of the forward frame portion 122 are appropriately secured together. Likewise, adjacent portions of the second edge 129 and the rear slide portion 140 are appropriately secured together and opposing portions of the rear frame portion 124 are appropriately secured together.

In various exemplary embodiments, the folded portions are stitched along at least certain of the mating or adjacent stitch lines 150 to form the protective cover 100. In certain exemplary embodiments, nylon thread may optionally be utilized to stitch certain portions of the protective cover 100 to appropriately secure adjacent portions of the protective cover 100, so that the protective cover 100 is usable through repeated applications and removals to and from the handgun 10. Alternatively, the portions may be appropriately secured using adhesives.

The opposing portions of the cover opening concavity portion 126 are not attached or secured together, but face each other to define a cover opening 127, as illustrated most clearly in FIG. 3. In various exemplary embodiments, portions of or the entire edge portion of the cover opening concavity portion 126 is provided with over-lock stitching 128. In this manner, all or at least a portion of the perimeter of the cover opening 127 is provided with over-lock stitching 128 to prevent fraying and to increase the integrity of the cover opening 127 and the protective cover 100.

It should be appreciated that over-stitching may optionally be provided around portions of or the entire perimeter of the material used to form the cover body 110.

In various exemplary embodiments, the over-lock stitching 128 for additional portions of over-lock stitching may comprise or secure an elastic portion to provide an additional degree of closing tension to the cover opening 127 or other portions of the protective cover 100 to assist in maintaining the protective cover 100 in a relatively secure and tight position about or around portions of the handgun 10.

In various exemplary embodiments, the cover opening 127 extends generally along at least a portion of the longitudinal axis of the protective cover 100. The cover opening 127 may be a relatively narrow opening that is expandable to allow at least a portion of a firearm to pass through the cover opening 127 and be fitted at least partially within the protective cover 100.

Figure 7:
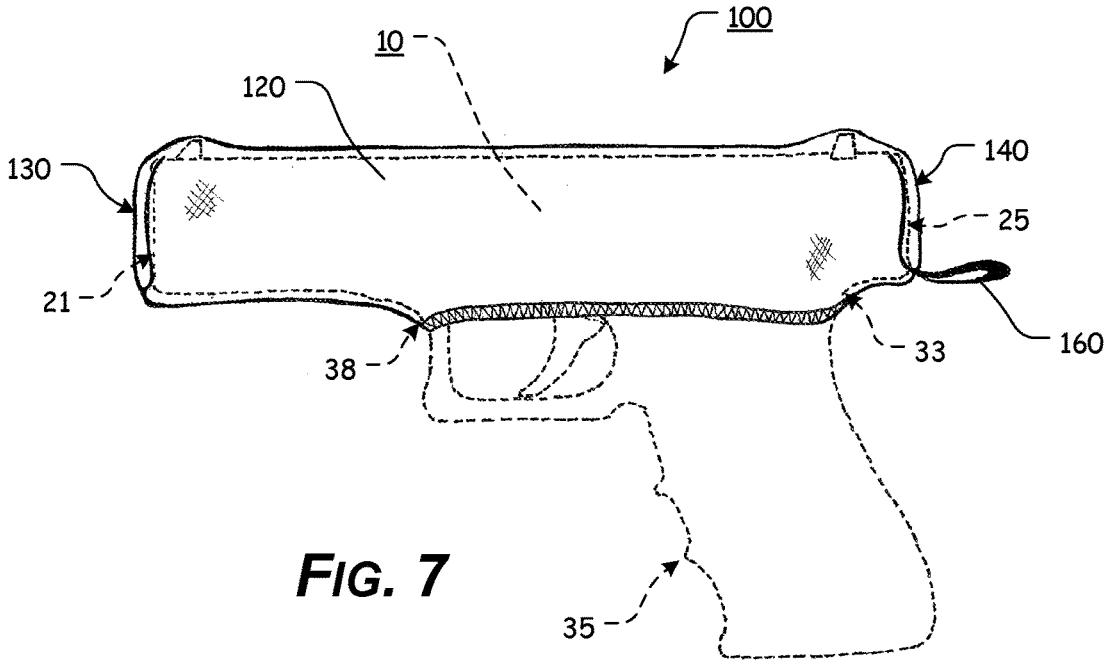
FIG. 7 illustrates a side view of the exemplary embodiment of the protective cover of FIG. 6, with an exemplary handgun partially inserted within the protective cover, according to the presently disclosed systems, methods, and/or apparatuses.

FIGS. 3-6, illustrate various views of an exemplary, nonlimiting embodiment of an assembled protective cover 100. As illustrated in FIG. 7, a portion of the handgun 10 has been passed through the cover opening 127 and then fitted at least partially within the protective cover 100. As illustrated, the cover opening 127 stretches between the dust cover/trigger guard interface 38 and the beavertail 33.

As further illustrated in FIG. 7, when the handgun 10 is at least partially fitted within the protective cover 100, the muzzle end 21 is disposed adjacent or typically against the inner surface of the front muzzle portion 130 and the rear end 25 of the slide 20 is disposed adjacent or typically against the inner surface of the rear slide portion 140. Remaining, covered portions of the handgun 10 are disposed adjacent or against remaining inner surfaces of the protective cover 100. At least a portion of the trigger guard 37 and a portion of the grip 35 extend from the cover opening 127.

In various exemplary embodiments, a portion of material extends from the protective cover 100, proximate the rear slide portion 140 to act as a pull tab 160 proximate the rear of the protective cover 100. The optional inclusion of a pull tab 160 allows the protective cover 100 to be more easily stretched and pulled into place and potentially assists in the reduction of stresses on the seams during application and removal of the protective cover 100. In various exemplary embodiments, the pull tab 160 comprises a loop of nylon or other material.

Thus, as illustrated in FIG. 7, at least portions of the protective cover 100 stretch or expand to take on a formed and fitted shape, which covers at least a portion of the handgun 10 from behind and below the rear sight (proximate the beavertail 33), forward along the top of the slide 20, and down both sides of the slide 20, over the entire length of the slide 20, over the front sight, down across the muzzle end 21, then reward beneath the forward frame dust cover 31 to the front of the trigger guard 37 (proximate the dust cover/trigger guard interface 38) thus keeping the surface of the slide 20 from directly contacting anything that could nick, scratch, mar, or otherwise damage the slide 20.

Figure 8:
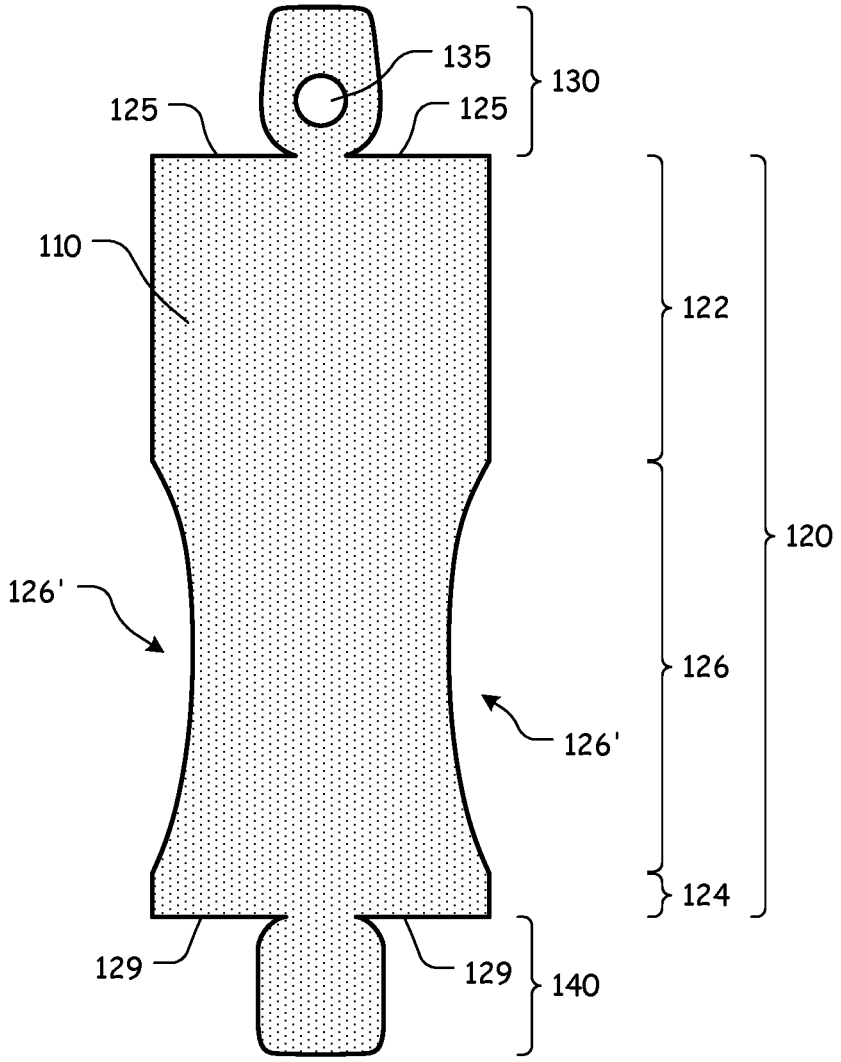
FIG. 8 illustrates a top view of an exemplary embodiment of a blank for a protective cover, according to the presently disclosed systems, methods, and/or apparatuses.
Figure 9:
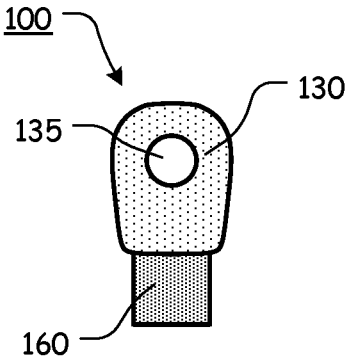
FIG. 9 illustrates a front view of an exemplary embodiment of a protective cover, according to the presently disclosed systems, methods, and/or apparatuses.
Figure 10:
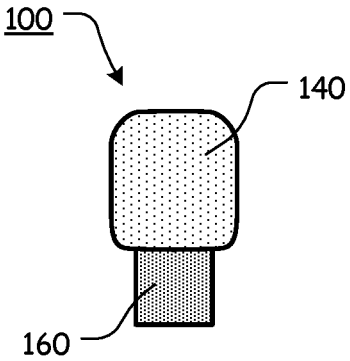
FIG. 10 illustrates a rear view of an exemplary embodiment of a protective cover, according to the presently disclosed systems, methods, and/or apparatuses.
Figure 11:
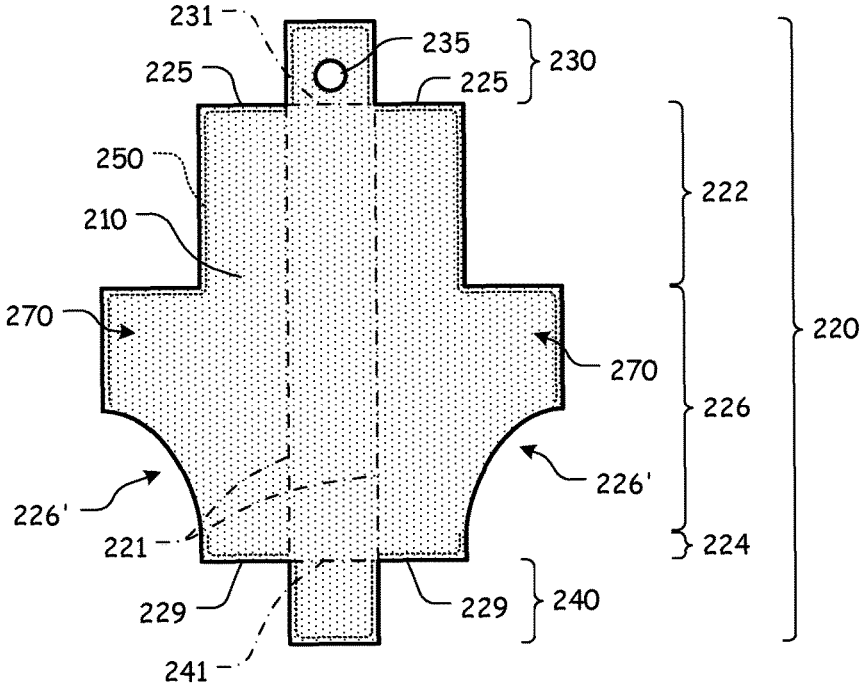
FIG. 11 illustrates a top view of an exemplary embodiment of a blank for a protective cover, according to the presently disclosed systems, methods, and/or apparatuses.
Figure 12:
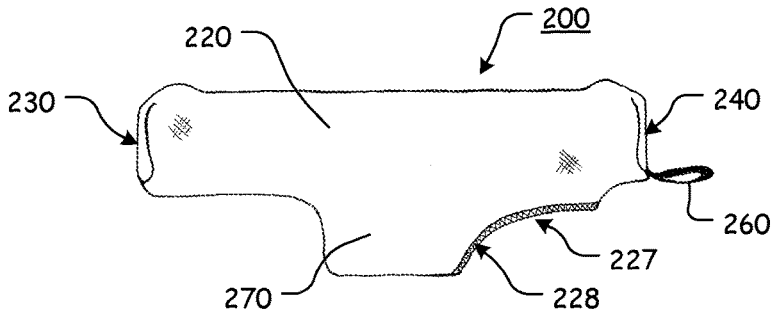
FIG. 12 illustrates a side view of an exemplary embodiment of a protective cover, according to the presently disclosed systems, methods, and/or apparatuses.
Figure 13:
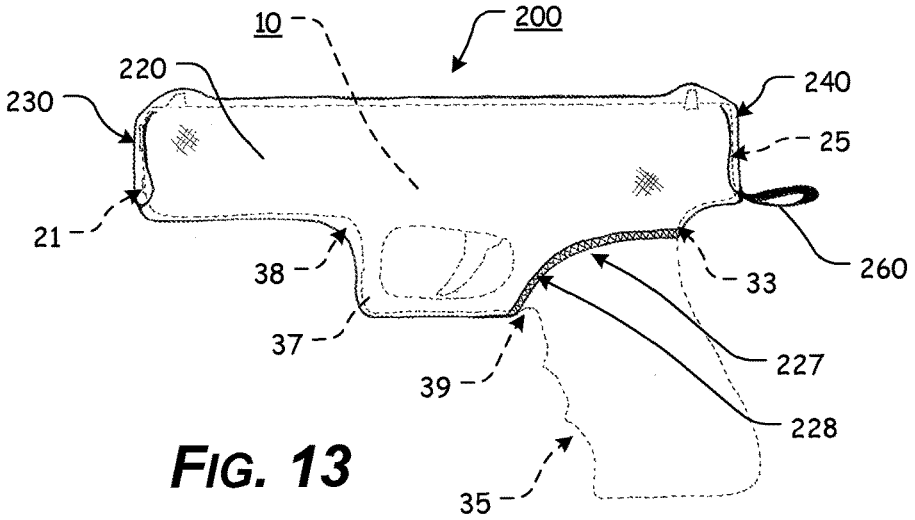
FIG. 13 illustrates a side view of the exemplary embodiment of the protective cover of FIG. 12, with an exemplary handgun partially inserted within the protective cover, according to the presently disclosed systems, methods, and/or apparatuses.

As illustrated in FIGS. 8-10, the overall dimensioning, size, and shape of each portion of the cover body 110 may be altered (when compared to the dimensioning, size, and shape of the cover body 110 illustrated in FIGS. 2-7) to more closely match and easily accommodate the dimensioning, size, and shape of the handgun with which the protective cover 100 is to be used.

FIGS. 11-16 illustrate an exemplary embodiment of a protective cover 200, according to the presently disclosed systems, methods, and/or apparatuses. As illustrated in FIGS. 11-16, the protective cover 200 comprises at least some of a cover body 210, a body portion 220, body portion fold lines 221, a forward frame portion 222, a rear frame portion 224, a first edge 225, cover opening concavity portion 226 and concavities 126', a cover opening 227, optional over-lock stitching 228, a second edge 229, a front muzzle portion 230, a front muzzle portion fold line 231, an optional barrel aperture 235, a rear slide portion 240, a rear slide portion fold line 241, stitch lines 250, and an optional pull tab 260.

It should be understood that each of these elements corresponds to and operates similarly to the cover body 110, the body portion 120, the body portion fold lines 121, the forward frame portion 122, the rear frame portion 124, the first edge 125, the cover opening concavity portion 126 and concavities 126', the cover opening 127, the optional over-lock stitching 128, the second edge 129, the front muzzle portion 130, the front muzzle portion fold line 131, the optional barrel aperture 135, the rear slide portion 140, the rear slide portion fold line 141, the stitch lines 150, and the optional pull tab 160, as described above with reference to the protective cover 100 of FIGS. 2-10.

However, as shown in FIGS. 11-16, the protective cover 200 further comprises a trigger guard cover portion 270. As illustrated, the trigger guard cover portion 270 extends between the forward frame portion 222 and the cover opening concavity portion 226. When compared to the cover opening concavity portion 126, the length of the cover opening concavity portion 226 (and the resulting cover opening 227) is generally shorter than the cover opening concavity portion 126 (and the resulting cover opening 127), because the trigger guard cover portion 270 extends so as to cover at least a portion, if not all, of the trigger guard 37 of the handgun 10.

In these exemplary embodiments, when the protective cover 200 is assembled and positioned over the handgun 10, the trigger guard cover portion 270 extends to cover the trigger guard 37 of the handgun 10. In various exemplary embodiments, the trigger guard cover portion 270 extends from the dust cover/trigger guard interface 38 to the trigger guard/grip interface 39. The cover opening 227 extends from the trigger guard/grip interface 39 to the beavertail 33. While the size and shape of the various handguns differs, when the handgun 10 is appropriately received within the protective cover 200, the slide 20 and a majority of the frame 30 (including the trigger guard 37) is positioned within the protective cover 200. Utilizing the protective cover 200, generally only a portion of the grip 35 extends from the protective cover 200.

Because the trigger guard cover portion 270 extends to cover the trigger guard 37, the protective cover 200 provides an additional feature, when compared to the protective cover 100, in that the protective cover 200 helps to shield against inadvertent contact with the trigger of the handgun 10, when the handgun 10 is appropriately inserted within the protective cover 200. Thus, when the protective cover 200 is in place, the material covering the trigger guard 37 can be sufficient to keep a user's finger or another object from inadvertently or unintentionally contacting the trigger of the handgun 10.

Depending upon at least the material used to form the cover body 210 and the tightness of the fit between at least certain portions of the protective cover 200 and the handgun 10 (both of which can be altered, as desired), the protective cover 200 can also reduce the possibility of debris entering or being trapped within the trigger guard.

Figure 14:
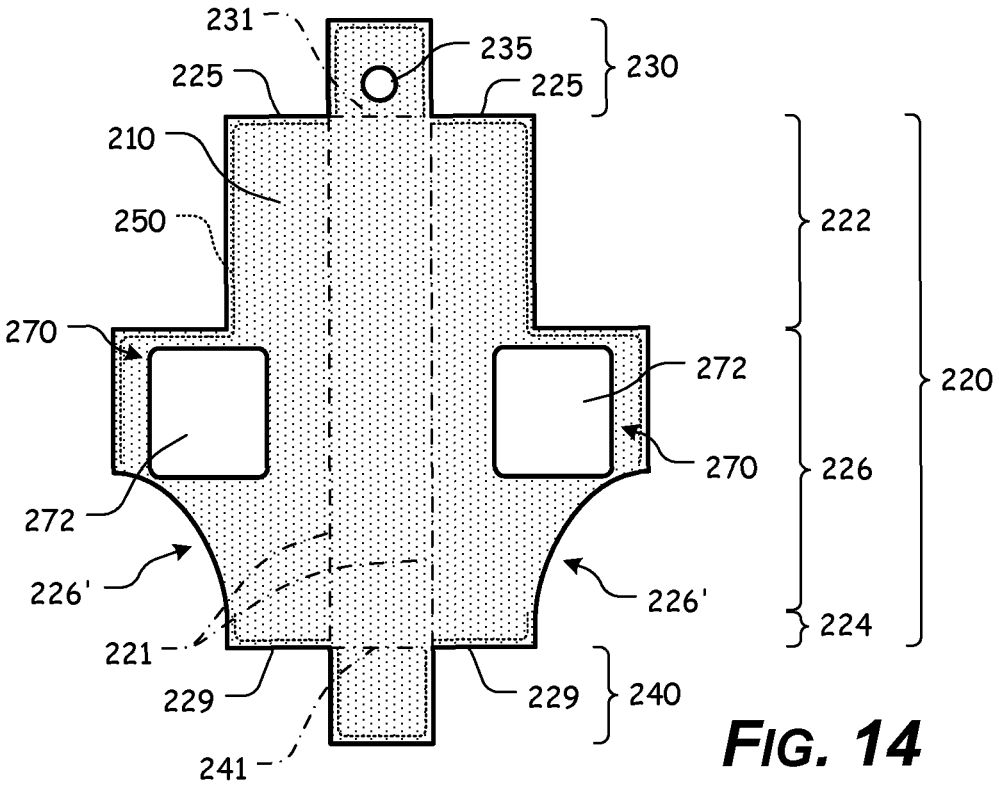
FIG. 14 illustrates a top view of an exemplary embodiment of a blank for a protective cover including two trigger blocking elements, according to the presently disclosed systems, methods, and/or apparatuses.
Figure 15:
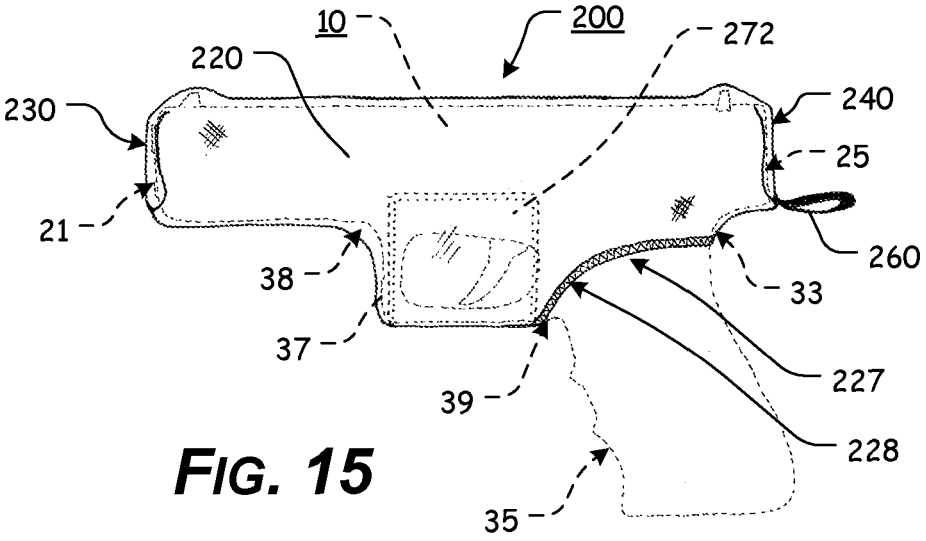
FIG. 15 illustrates a side view of the exemplary embodiment of the protective cover of FIG. 14, with an exemplary handgun partially inserted within the protective cover, according to the presently disclosed systems, methods, and/or apparatuses.
Figure 16:
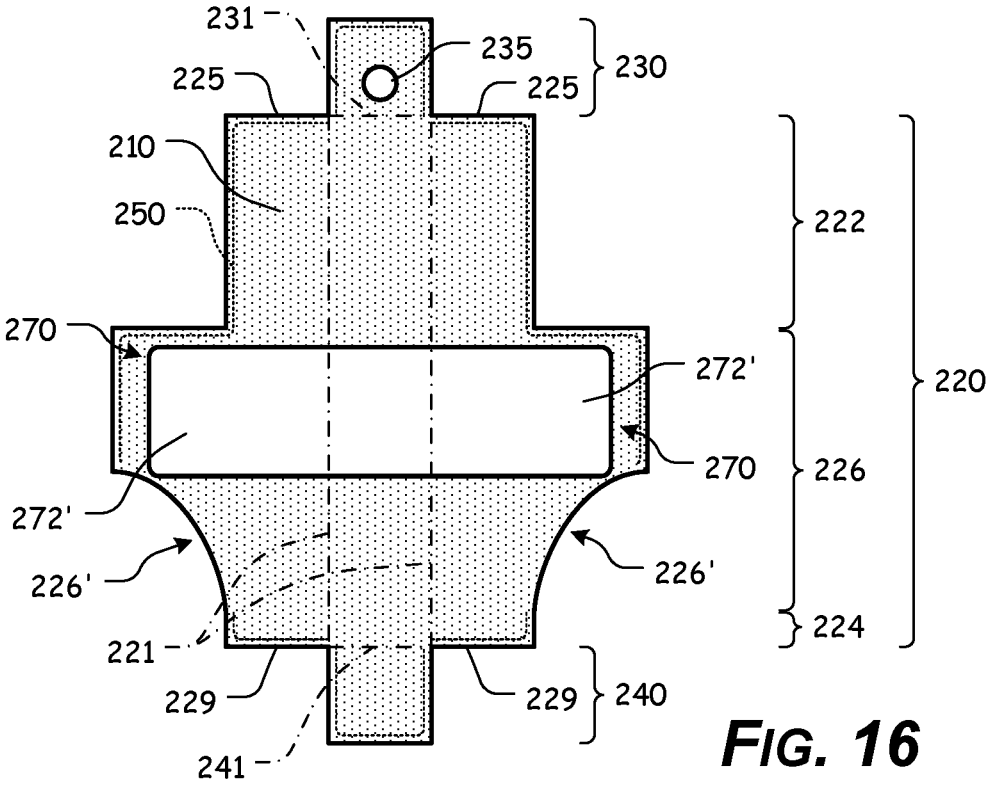
FIG. 16 illustrates a top view of an exemplary embodiment of a blank for a protective cover including a trigger blocking element, according to the presently disclosed systems, methods, and/or apparatuses.

If additional security against inadvertent contact with the trigger of the handguard 10 is desired, one or more trigger blocking elements 272 may be included to provide additional rigidity to at least a portion of one or both of the trigger guard portions 270. As illustrated in FIGS. 14-15, a discrete trigger blocking element 272 is included on opposing sides of the trigger guard portions 270. Alternatively, as illustrated in FIG. 16, a single, elongate trigger blocking element 272' is included that bridges across opposing sides of the trigger guard portions 270. If a single trigger blocking element 272 is utilized, the size and shape of the trigger blocking element 272' may be altered, as desired, to more appropriately flex or fit the covered handgun 10.

In this manner, when the handgun 10 is appropriately inserted within the protective cover 200, as illustrated most clearly in FIG. 15, a trigger blocking element 272 is positioned on both sides of the trigger guard 37 and further prevents portions of the cover body 110 from being deformed and allowing contact with the trigger of the inserted firearm.

In certain exemplary embodiments, the one or more trigger blocking elements 272 are attached or coupled to an inner surface of the protective cover 200. Alternatively, the one or more trigger blocking elements 272 may be attached or coupled to an outer surface of the protective cover 200. The one or more trigger blocking elements 272 may be attached or coupled to a surface of the protective cover 200 using, for example, stitching, and/or adhesives.

In various exemplary embodiments, each trigger blocking element 272 is substantially rigid and is formed of a portion of plastic, such as, for example, Teflon. Alternate materials of construction of each trigger blocking element 272 may include one or more of the following: aluminum, steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form each trigger blocking element 272 is a design choice based on the desired appearance and/or functionality of each trigger blocking element 272.

Figure 17:
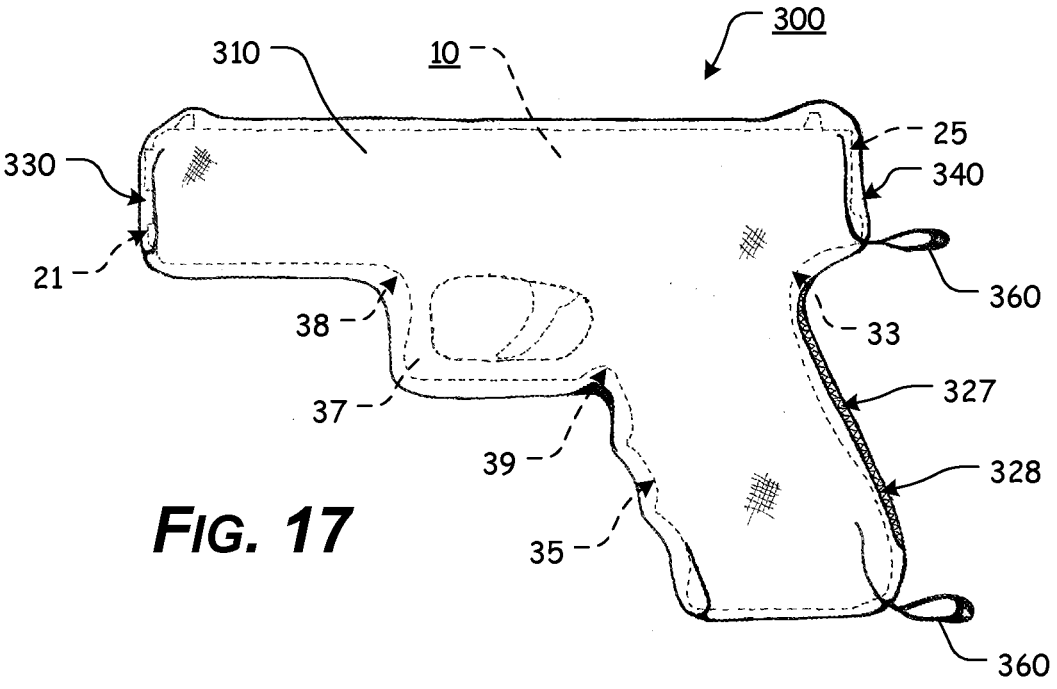
FIG. 17 illustrates a side view of the exemplary embodiment of the protective cover of FIG. 16, with an exemplary handgun partially inserted within the protective cover, according to the presently disclosed systems, methods, and/or apparatuses.

FIG. 17 illustrates an exemplary embodiment of a protective cover 300, according to the presently disclosed systems, methods, and/or apparatuses. As illustrated in FIG. 17, the protective cover 300 comprises elements that correspond to and operate similarly to the protective cover 100 of FIGS. 2-10 and/or the protective cover 200 of FIGS. 11-16. However, as illustrated in FIG. 17, the protective cover 300 not only includes a cover body 310 that extends from the front muzzle portion 330 to the rear slide portion 340, but also extends to completely cover the grip 35 of the handgun 10.

In this exemplary embodiment, the cover opening concavity portions are formed so that the cover opening 327 is located along at least a portion of the back of the grip 35. In this manner, the entire handgun 10 can be inserted through the cover opening 327 and secured within the protective cover 300.

In certain exemplary embodiments, a perimeter of the cover opening 327 is at least partially surrounded by optional over-lock stitching 328. In various exemplary embodiments, instead of or in addition to the over-lock stitching 328, a releasable closure device may be included that allows the two, opposing cover opening concavity portion to be releasably joined together, so that the cover opening 327 can be maintained in a closed position. In various exemplary embodiments, the releasable closure device comprises releasable fasteners such as male/female snap-release buckles, hook-and-loop fasteners, an interlocking closure device, a zipper, buttons, snaps, magnets, or other fastening or closure means known to those skilled in the art.

In this manner, the handgun 10 can be inserted through the cover opening 327 and secured within the protective cover 300. Then, the releasable closure device can be utilized to releasably close the cover opening 327.

As illustrated, the protective cover 300 may comprise one or more optional pull tabs 360, which allow the protective cover 300 to be more easily stretched and pulled into place and potentially assist in the reduction of stresses on the seams during application and removal of the protective cover 300.

Figure 18:
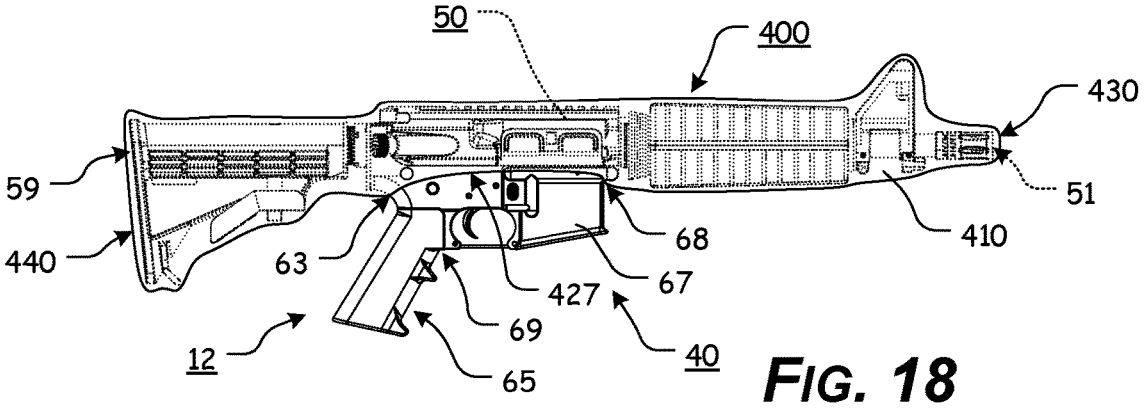
FIG. 18 illustrates a side view of an exemplary embodiment of a protective cover with an exemplary rifle partially inserted within the protective cover, according to the presently disclosed systems, methods, and/or apparatuses.
Figure 19:
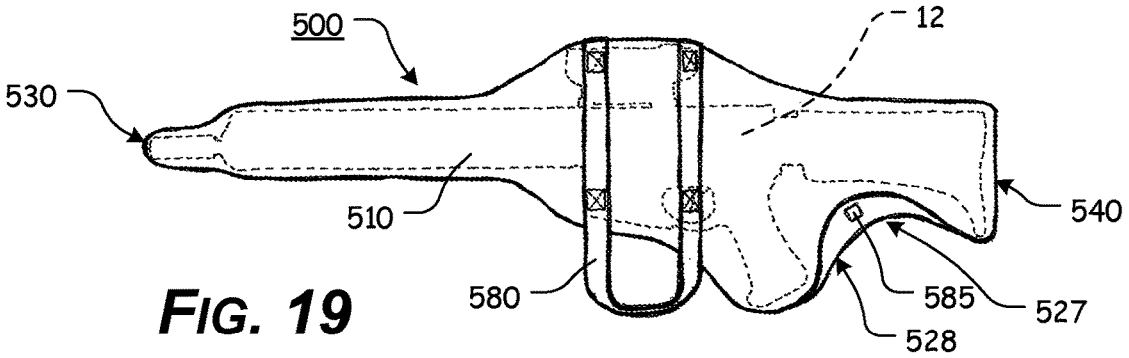
FIG. 19 illustrates a side view of an exemplary embodiment of a protective cover with an exemplary rifle inserted within the protective cover, according to the presently disclosed systems, methods, and/or apparatuses.

FIGS. 18-19, illustrate various exemplary embodiments of a protective cover fora rifle 12. As illustrated, the rifle 12 includes a lower receiver 40 and an upper receiver 50. The rifle extends from a rear buttstock 59 to a muzzle and 51. The lower receiver includes a magazine well/trigger guard assembly 67 and a grip 65. A beavertail 63 is formed proximate the junction between the rear of the grip 65 and the remaining portion of the lower receiver 40. A grip/lower interface 69 is formed proximate the junction between the front of the grip 65 and the magazine well/trigger guard assembly 67. A pivot pin interface 68 is formed proximate the junction between the front of the lower receiver 40 and the upper receiver 50. It is believed that a more detailed description of these elements and the overall rifle 12 is unnecessary, as such elements are known in the art.

As illustrated in FIG. 18, the protective cover 400 includes a cover body 410 that extends from a rear portion 440 to a front muzzle portion 430. The cover opening 427 extends between the pivot interface 68 and the beavertail 63.

It should be appreciated that, in certain exemplary embodiments, the cover opening 427 may be formed so as to extend further on the lower receiver 40, such that the cover opening 427 only allows a portion of the grip 65 to extend from the protective cover 400.

As illustrated in FIG. 19, the protective cover 500 includes a cover body 510 that extends from a rear portion 542 a front muzzle portion 530.

As illustrated, the cover body 510 is formed so as to allow the entire rifle 12 (including an attached optic) to be received within the protective cover 500.

In this exemplary embodiment, the cover opening concavity portions are formed so that the cover opening 527 is located along at least a portion between the rear portion 540 and the front muzzle portion 530. In this manner, the entire rifle 12 can be inserted through the cover opening 527 and secured within the protective cover 500.

In certain exemplary embodiments, a perimeter of the cover opening 527 is at least partially surrounded by optional over-lock stitching 528. In various exemplary embodiments, instead of or in addition to the over-lock stitching 528, a releasable closure device 585 may be included that allows the two, opposing cover opening concavity portion to be releasably joined together, so that the cover opening 527 can be maintained in a closed position. In various exemplary embodiments, the releasable closure device comprises releasable fasteners such as male/female snap-release buckles, hook-and-loop fasteners, an interlocking closure device, a zipper, buttons, snaps, magnets, or other fastening or closure means known to those skilled in the art.

In this manner, the rifle 12 can be inserted through the cover opening 527 and secured within the protective cover 500. Then, the releasable closure device can be utilized to releasably close the cover opening 527.

As illustrated, the protective cover 500 may optionally comprise one or more straps or handles 580, which allow the protective cover 500 to be more easily carried. In this manner, the protective cover 500 can act as not only a removable, protective cover, but also as a carrying case for the rifle 12.

While not illustrated, it should be appreciated that the protective cover 500 may optionally include one or more trigger blocking elements, positioned so as to cover at least a portion of the trigger guard of the rifle 12.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

In addition, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A protective cover for a firearm, comprising:

a front muzzle portion;

a rear slide portion spaced apart from said front muzzle portion, wherein said rear slide portion covers a rear portion of a slide of said firearm and wherein said rear slide portion covers a rear portion of a frame adjacent said rear portion of said slide of said firearm if said firearm is disposed within said protective cover;

an elongate body portion extending between and secured to said front muzzle portion and said rear slide portion;

a trigger guard cover portion that extends from said body portion to cover at least a portion of a trigger guard of said firearm if said firearm is disposed within said protective cover; and a longitudinally extending cover opening in said body portion through which at least a portion of said firearm extends to be disposed within said protective cover, wherein said cover opening extends between said trigger guard cover portion and said rear slide portion; wherein at least a portion of a grip of said firearm extends from said protective cover if said firearm is disposed within said protective cover, and wherein at least a portion of said protective cover is impregnated with a rust inhibitor, an oil, or a desiccant.

2. The protective cover of claim 1, wherein said trigger guard cover portion extends from a dust cover/trigger guard interface to a trigger guard/grip interface of said firearm if said firearm is disposed within said protective cover.

3. The protective cover of claim 1, wherein said protective cover comprises a substantially elastic or flexible fabric or other material.

4. The protective cover of claim 1, wherein said protective cover comprises a nylon outer portion, a nylon inner portion, and a neoprene or other closed cell foam material positioned between said outer portion and said inner portion.

5. The protective cover of claim 1, further comprising one or more trigger blocking elements attached or coupled to at least a portion of said trigger guard cover portion to provide additional rigidity to said trigger guard cover portion.

6. The protective cover of claim 5, wherein said one or more trigger blocking elements comprises a single, elongate trigger blocking element that bridges across opposing sides of said trigger guard cover portion.

7. The protective cover of claim 1, further comprising a trigger blocking element positioned on at least one side of said trigger guard cover portion.

8. The protective cover of claim 1, wherein a barrel aperture is formed in said front muzzle portion such that, when said firearm is disposed within said protective cover, a barrel of said firearm is aligned with said barrel aperture.

9. The protective cover of claim 1, further comprising a pull tab attached or coupled to said protective cover proximate said rear of said protective cover.

10. A protective cover for a firearm, comprising:

a front muzzle portion;

a rear slide portion spaced apart from said front muzzle portion;

an elongate body portion extending between and secured to said front muzzle portion and said rear slide portion, wherein said body portion extends to a trigger guard cover portion that covers said trigger guard of said firearm if said firearm is disposed within said protective cover, and wherein said body portion extends to cover a grip of said firearm if said firearm is disposed within said protective cover; and a cover opening formed proximate a rear of said grip, wherein at least a portion of said protective cover is impregnated with a rust inhibitor, an oil, or a desiccant.

11. The protective cover of claim 10, wherein said cover opening extends between at least some of said trigger guard cover portion and said rear slide portion.

12. The protective cover of claim 10, wherein at least a portion of said cover opening comprises a releasable closure device that allows opposing cover opening concavities of said cover opening to be releasably joined together.

13. The protective cover of claim 10, wherein said protective cover comprises a substantially elastic or flexible fabric or other material.

14. The protective cover of claim 10, wherein said protective cover comprises a nylon outer portion, a nylon inner portion, and a neoprene or other closed cell foam material positioned between said outer portion and said inner portion.

15. The protective cover of claim 10, further comprising one or more trigger blocking elements attached or coupled to at least a portion of said trigger guard cover portion to provide additional rigidity to said trigger guard cover portion.

16. The protective cover of claim 10, further comprising a pull tab attached or coupled to said protective cover proximate said rear of said protective cover.

17. A protective cover for a firearm, comprising:

a body portion extending from a first edge to a forward frame portion, wherein said forward frame portion extends to a cover opening concavity portion, wherein said cover opening concavity portion extends to a rear frame portion, and wherein said rear frame portion extends to a second edge, wherein said cover opening concavity portion comprises opposing concavities that extend inwardly from opposing sides of said cover opening concavity portion, and wherein at least a portion of a grip of said firearm extends from said cover opening concavity portion if said firearm is disposed within said protective cover;

a front muzzle portion, wherein said front muzzle portion extends from said first edge;

a front muzzle portion, wherein said front muzzle portion extends from said first edge; and a rear slide portion, wherein said rear slide portion extends from said second edge, wherein said rear slide portion covers a rear portion of a slide and wherein said rear slide portion covers a rear portion of a frame adjacent said rear portion of said slide of said firearm if said firearm is disposed within said protective cover, and wherein at least a portion of said protective cover is impregnated with a rust inhibitor, an oil, or a desiccant.

18. The protective cover of claim 17, further comprising a trigger guard cover portion, wherein said trigger guard cover portion extends between said forward frame portion and said cover opening concavity portion.

* * * * *